US009892635B2

(12) United States Patent
Suzuki

(10) Patent No.: US 9,892,635 B2
(45) Date of Patent: Feb. 13, 2018

(54) CONGESTION INFORMATION GENERATION DEVICE AND CONGESTION INFORMATION GENERATION METHOD

(71) Applicant: TOYOTA JIDOSHA KABUSHIKI KAISHA, Toyota-shi, Aichi-ken (JP)

(72) Inventor: Koichi Suzuki, Miyoshi (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 4 days.

(21) Appl. No.: 15/067,852

(22) Filed: Mar. 11, 2016

(65) Prior Publication Data

US 2016/0284211 A1 Sep. 29, 2016

(30) Foreign Application Priority Data

Mar. 25, 2015 (JP) ..... 2015-063223

(51) Int. Cl.
*G08G 1/01* (2006.01)

(52) U.S. Cl.
CPC ..... *G08G 1/0112* (2013.01); *G08G 1/0133* (2013.01); *G08G 1/0141* (2013.01)

(58) Field of Classification Search
CPC ... G08G 1/0112; G08G 1/0141; G08G 1/0133
See application file for complete search history.

(56) References Cited

U.S. PATENT DOCUMENTS

2006/0223529 A1 10/2006 Yokota et al.
2013/0332056 A1 12/2013 Huang et al.
2015/0221216 A1* 8/2015 Stenneth ..... G08G 1/0112 701/117

FOREIGN PATENT DOCUMENTS

| | | | |
|---|---|---|---|
| JP | 2005-267470 | A | 9/2005 |
| JP | 2006-059058 | A | 3/2006 |
| JP | 2006-285567 | A | 10/2006 |
| JP | 2006-350530 | A | 12/2006 |
| JP | 2007-114128 | A | 5/2007 |
| JP | 2008-146248 | A | 6/2008 |
| JP | 2012-137834 | A | 7/2012 |
| JP | 2012-137835 | | 7/2012 |
| JP | 2014-157522 | | 8/2014 |

* cited by examiner

*Primary Examiner* — Mussa A Shaawat
*Assistant Examiner* — Michael V Kerrigan
(74) *Attorney, Agent, or Firm* — Finnegan, Henderson, Farabow, Garrett & Dunner, LLP

(57) ABSTRACT

An information generator may generate congestion information of a road link based on a link velocity calculated for the road link. A section velocity calculator may calculate a section velocity based on a plurality of pieces of position information and time information mapped on the road link. An information generator may determine, for each mobile information device, whether the link velocity calculated for the road link will be used for generation of the congestion information. The information generator may determine whether the link velocity will be used for generation of the congestion information based on a predetermined number or more of the section velocities.

16 Claims, 9 Drawing Sheets

CONGESTION INFORMATION GENERATION DEVICE AND CONGESTION INFORMATION GENERATION METHOD

BACKGROUND

The present disclosure relates to a congestion information generation device for generating road congestion information and a congestion information generation method.

In techniques of generating road congestion information in real time and providing the information to automobiles has been known, such congestion information may be convenient when provided for more roads as more detailed information. However, in a technique of generating congestion information based on information obtained from sensors provided on road sides, for example, the road for which the congestion information is generated is limited to roads on which sensors are provided, and it may be difficult to obtain information on the length of congestion and the like. Therefore, an example of a technique of generating congestion information based on the position information and the time information of mobile terminals that are moving on a road is proposed in Japanese Laid-Open Patent Publication No. 2012-137835.

A congestion information generation device disclosed in Japanese Laid-Open Patent Publication No. 2012-137835 includes a GPS information collecting means and a link velocity calculating means. The GPS information collecting means stores matching position information, at which GPS position information measured by mobile terminals matches a road link in a storage device in correlation with a road link ID together with position measurement time information corresponding to the GPS position information. The link velocity calculating means calculates a moving velocity of the mobile terminal based on the distance and the difference in position measurement time between a matching position closest to a starting point of a subject road link and a matching position closest to an ending point of the subject road link, among a plurality of matching positions present successively in time in the subject road link. The congestion information generation device generates congestion information of the subject road link based on the calculated moving velocity.

According to the congestion information generation device disclosed in Japanese Laid-Open Patent Publication No. 2012-137835, it is possible to generate congestion information of a road on which a mobile information device (mobile terminal) moves as well as a road in which sensors are provided on road sides. However, it may not be said that all the mobile information devices from which the position information is acquired are held by the occupants of travelling automobiles. Thus, when the congestion information is generated from velocity data obtained based on the position information and the time information acquired from a mobile information device, the velocity data also includes a velocity obtained based on the information of a mobile information device held by a pedestrian rather than an occupant of a travelling automobile, an occupant of a parked automobile, and the like. When the velocity data includes the velocity obtained based on the information of mobile information devices held by users who are not in the travelling automobile, the accuracy of the congestion information generated based on the velocity will be low.

Thus, embodiments of the present disclosure provide congestion information generation devices and methods that may improve accuracy of road congestion information generated from velocity based on information obtained from a mobile information device.

SUMMARY

In accordance with embodiments of the present disclosure, a congestion information generation device is provided, which generates congestion information for a road link. A plurality of pieces of position information and time information acquired from one or a plurality of mobile information devices may be mapped on the road link. The congestion information generation device may be configured to generate the congestion information based on the position information and the time information for the road link. The congestion information generation device may include a link velocity calculator, an information generator, and section velocity calculator. The link velocity calculator may be configured to calculate a link velocity of the road link for each of the mobile information devices. The link velocity calculator may be configured to calculate the link velocity of the road link from the position information and the time information closest to a starting point of the road link and the position information and the time information of an ending point of the road link among the plurality of pieces of position information and time information mapped on the road link. The information generator may be configured to generate the congestion information of the road link based on the link velocity calculated for the road link. The section velocity calculator may be configured to calculate a section velocity of a plurality of sections in the road link for each of the mobile information devices. The section velocity calculator may be configured to calculate the section velocity based on the plurality of pieces of position information and time information mapped on the road links. The information generator may be configured to determine for each of the mobile information devices whether the link velocity calculated for the road link will be used for generation of the congestion information. The information generator may be configured to determine whether the link velocity will be used for generation of the congestion information based on at least a predetermined number or more of the section velocities.

In accordance with embodiments of the present disclosure, a congestion information generation method for generating congestion information for a road link is provided. A plurality of pieces of position information and time information acquired from one or a plurality of mobile information devices may be mapped on the road link. The congestion information generation method may be configured to generate the congestion information based on the position information and the time information for the road link. The congestion information generation method may include: allowing a link velocity calculator to calculate a link velocity of the road link for each of the mobile information devices and to calculate the link velocity of the road link for each of the mobile information devices from the position information and the time information closest to a starting point of the road link and the position information and the time information closest to an ending point of the road link among the plurality of pieces of position information and time information mapped on the road link; allowing an information generator to generate the congestion information of the road link based on the link velocity calculated for the road link; and allowing a section velocity calculator to calculate a section velocity of a plurality of sections in the road link for each of the mobile information devices and calculate the section velocity based on the plurality of pieces of position information and time information mapped on the road links. The information generator may determine for each of the mobile information devices whether the link velocity calculated for the road link will be used for generation of the congestion information. The information generator may determine whether the link velocity will be used for generation of the congestion information based on at least a predetermined number or more of the section velocities.

Since mobile information devices may be held by pedestrians, train passengers, and the like, it may not be said that the position information and the time information obtained from the mobile information devices are obtained from automobiles, which are suitable as subjects of congestion information. That is, when the congestion information is generated while including a velocity based on information obtained from a moving object other than an automobile, such as a pedestrian, the accuracy of the congestion information may be lowered. According to the above described configuration and method, whether the link velocity of a road link will be used for generation of congestion information may be determined based on the section velocity of each section in the road link for the respective mobile information devices. Thus, the link velocity based on the position information and the time information obtained from a mobile information device that may not be suitable for generation of congestion information is excluded, and the likelihood is increased that the position information and the time information will be obtained from a mobile information device that is suitable for generation of the congestion information. Thus, the accuracy of the congestion information generated from the velocity based on the information obtained from a mobile information device may be improved.

In embodiments of the present disclosure, the information generator may be configured such that, when all the section velocities calculated in one of the road links are less than or equal to a predetermined value, the link velocity obtained from the mobile information device is not used for generation of the congestion information. Accordingly, a condition that all the section velocities calculated for a plurality of sections in a road link are less than or equal to the predetermined value (for example, a case in which the section velocities are not larger than the velocity of a pedestrian) may be excluded. Thus, the likelihood is increased that the link velocity will be obtained from a mobile information device that is suitable for generation of congestion information.

In embodiments of the present disclosure, the link velocity calculator may be configured to perform at least one of: exclusion of the position information and the time information within a predetermined distance from the starting point of the road link when determining the position information and the time information closest to the starting point of the road link; and exclusion of the position information and the time information within the predetermined distance from the ending point of the road link when determining the position information and the time information closest to the ending point of the road link.

The end of a road link is may be a connection point or the like of roads and a traffic signal, and various restrictions may be present at the ending point. Thus, such an ending point may not be suitable for generation of congestion information. Thus, by calculating the link velocity by excluding the position information and the time information within a predetermined distance from the starting point or the ending point of the road link, it may be possible to further improve the accuracy of the congestion information.

In embodiments of the present disclosure, the link velocity calculator may be configured to perform at least one of: exclusion of a section that is continuous from the starting point of the road link while exhibiting a velocity outside a predetermined velocity range when determining the position information and the time information closest to the starting point of the road link; and exclusion of a section that is continuous from the ending point of the road link while exhibiting a velocity outside the predetermined velocity range when determining the position information and the time information closest to the ending point.

The end of a road link may be a connection point or the like of roads, and a traffic signal and various restrictions may be present at the ending point. Thus, such an ending point may not be suitable for generation of congestion information. Thus, by calculating the link velocity by excluding the position information and the time information of a section continuous from the starting point or the ending point of the road link while exhibiting a velocity outside the predetermined velocity range, it may be possible to further improve the accuracy of the congestion information.

In embodiments of the present disclosure, when all the section velocities are calculated in one of the road links, the information generator may be configured to determine that road link as a subject of which the congestion information is to be generated. When at least some of the section velocities are not calculated in one of the road links, the information generator may be configured not to determine that road link as a subject of which the congestion information is to be generated.

Accordingly, since an automobile may generally move from the starting point to the ending point of a road link, when all the section velocities of one road link are calculated, the possibility may be increased that the link velocity of the road link will be based on the movement of an automobile. In contrast, when at least some of the section velocities of one road link are not calculated, the possibility that the link velocity of the road link is not based on the movement of an automobile may increase. In this manner, by using, as a subject of which the congestion information is to be generated, a road link in which the possibility is high that the link velocity will be based on the mobile information device of an automobile, which is suitable for calculation of the congestion information, the high accuracy of the congestion information may be maintained for the road link.

In embodiments of the present disclosure, the information generator may be configured to determine a plurality of the road links in a first sequence as subjects of which the congestion information is to be generated. A road route, which may include the road links, may form the road links in a second sequence. The information generator may be configured such that, when the first sequence is different from the second sequence, the link velocities calculated for the road link determined in the first sequence are not used for generation of the congestion information.

An automobile may generally move along road links in the second sequence following a road route. Thus, the link velocities of road links in which the first sequence as the determined sequence of a plurality of road links is not aligned according to the second sequence as the sequence of a plurality of road links following the road route may not be used. Thus, it is possible to reduce the possibility that the link velocity of a moving object other than the automobile will be used for generation of congestion information. For example, in a moving route of a moving object moving along a route other than a road such as a river and a sea, a canal, the sky, a field, a mountain, or an exclusive track, the plurality of determined road links may not be aligned according to the second sequence that follows a road route.

In embodiments of the present disclosure, the information generator may be configured such that, when the road link determined as the subject of which the congestion information is to be generated is connected to a non-determined road link and is adjacent to a railroad track, the link velocity calculated for the determined road link may not be used for generation of the congestion information.

Although roads may extend in parallel with a railroad track, when a determined road link is connected to a non-determined road link and extends along a railroad track, there is a possibility that the mobile information device has moved along a railroad track. That is, there is a possibility that a determined road link may extend along a railroad track. Accordingly, however, the link velocity that is not suitable for generation of congestion information may not be used for generation of the congestion information.

Other aspects of the present disclosure will become apparent from the following description, taken in conjunction with the accompanying drawings, illustrating by way of example the principles of the disclosure.

BRIEF DESCRIPTION OF THE DRAWINGS

The disclosure may be understood by reference to the following description of embodiments together with the accompanying drawings.

DETAILED DESCRIPTION

Figure 1:
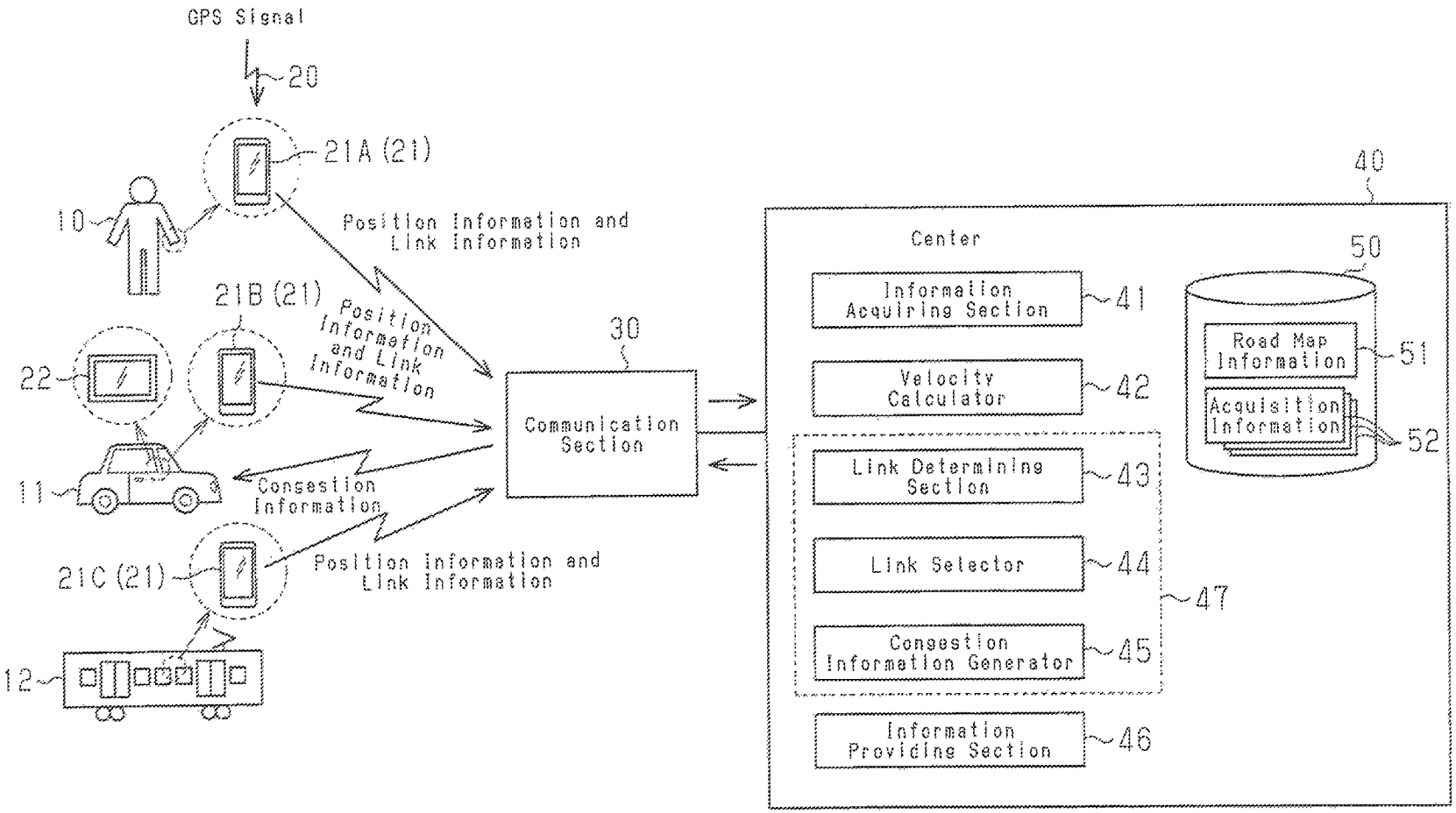
FIG. 1 is a block diagram illustrating a schematic configuration of a congestion information generation device according to a first embodiment.

An overview of a congestion information generation device and a congestion information generation method according to an embodiment will be described with reference to FIG. 1. A congestion information generation device generates congestion information of a road link based on a plurality of pieces of position information and time information, which are acquired from a mobile information device 21 and are mapped on the road link. The mobile information device 21 is an information processing device such as a smartphone or a feature phone, which has a known wireless communication function and can be carried by a user. The mobile information device 21 can detect present position information by receiving a GPS signal 20 or the like and can output the position information, the time information, and the like detected in this manner to a center 40 via a communication section 30 having a communication function. Examples of the user carrying the mobile information device 21 include a pedestrian 10, an occupant of an automobile 11, and a passenger of a train 12. Moreover, the center 40 is configured to exchange information with the mobile information device 21 via the communication section 30. The center 40 has an information processing function and an information storing function. The center 40 acquires the position information, the time information, and the like transmitted from the mobile information device 21, stores the information in a storage section 50, calculates a velocity based on the position information and the time information acquired in this manner, generates congestion information for a road link, and provides the congestion information to the automobile 11.

First Embodiment

A congestion information generation device and a congestion information generation method according to a first embodiment will be described with reference to FIGS. 1 to 6.

The mobile information device 21 is carried by a user and detects position information such as the present longitude and latitude and the like of a moving destination. Moreover, the mobile information device 21 can be classified, by the mode in which the device is carried, into a mobile information device 21A carried by a pedestrian 10, a mobile information device 21B carried by an occupant of an automobile 11, a mobile information device 21C carried by a passenger of a train 12, and the like. In any carrying mode, the mobile information devices 21A, 21B, and 21C can communicate with a communication section 30 including a base station for wireless communication. In the following description, the mobile information devices 21A, 21B, and 21C will be distinguished from each other when the carrying modes are classified, and will be referred to simply as the mobile information device 21 when the carrying modes are not classified.

Upon detecting the present position information, the mobile information device 21 detects the time information at that time. The mobile information device 21 correlates the present position information with road links by collating the detected present position information with road map information. The road map information includes road links as information for identifying roads and various types of information on roads. The road link is configured to identify another road link connected to the link by nodes associated with both ends of the link. Thus, when a road route is determined, the sequence of road links is automatically determined and the second sequence as the sequence of road links corresponds to the road route. The mobile information device 21 may store the road map information and acquire the information by communication. The mobile information device 21 identifies a road link corresponding to the detected position information by mapping, which is a process for collating the position information with the road map information and correlates the position information and the road link together. Moreover, the mobile information device 21 may transmit the position information to an external server to acquire a road link correlated by the external server to which the position information is transmitted. Upon obtaining the detected position information, the time information, and link information including the road link, the mobile information device 21 outputs these three pieces of information to the center 40 via the communication section 30.

The center 40 acquires the position information, the time information, and the link information from the mobile information device 21 to generate congestion information of the road link based on the acquired respective pieces of information. The center 40 includes an information acquiring section 41, which acquires information from the mobile information device 21, and a velocity calculator 42 as a link velocity calculator and a section velocity calculator, which calculates a moving velocity. Moreover, the center 40 includes a link determining section 43, which determines a road link of which the congestion level is to be generated, a link selector 44, which selects a road link suitable for generation of congestion information, and a congestion information generator 45, which generates congestion information. In the present embodiment, the link determining section 43, the link selector 44, and the congestion information generator 45 form an information generator 47. Further, the center 40 includes an information providing section 46, which provides the generated congestion information and a storage section 50 for storing various types of information required for the process for generating congestion information. The storage section 50 stores road map information 51 including road links and acquisition information 52 in which the position information, the time information, and the link information acquired from the mobile information devices 21 are maintained for each mobile information device 21. In the present embodiment, the velocity calculator 42 performs a link velocity calculating step and a section velocity calculating step and the information generator 47 performs an information generating step. These sections of the center 40 like the information acquiring section 41, the velocity calculator 42, the link determining section 43, the link selector 44, the congestion information generator 45, the information providing section 46 and the information generator 47 may be configured by circuitry and/or ECUs of the center 40.

That is, the center 40 generates congestion information by using the congestion information generator 45 based on the position information, the time information, and the link information acquired from the plurality of mobile information devices 21 and provides the generated congestion information to external apparatuses such as the automobile 11 via the communication section 30. The automobile 11 having received the congestion information notifies the occupant of the automobile 11 of the received congestion information by using a navigation device 22, the mobile information device 21B, and the like.

Operation of the mobile information device 21 will be described with reference to FIGS. 2 and 3.

The mobile information device 21 receives a GPS signal 20 at each predetermined time interval such as every X seconds to detect present position information P0, P1, P2, . . . , and PN and time information. Moreover, the mobile information device 21 detects a road link L1 corresponding to the present position information by mapping the position information on road map information. In the present embodiment, the X second interval is one second, for example, and the position information is acquired every second. The X second interval may be longer than one second and may be shorter than one second.

Figure 2:
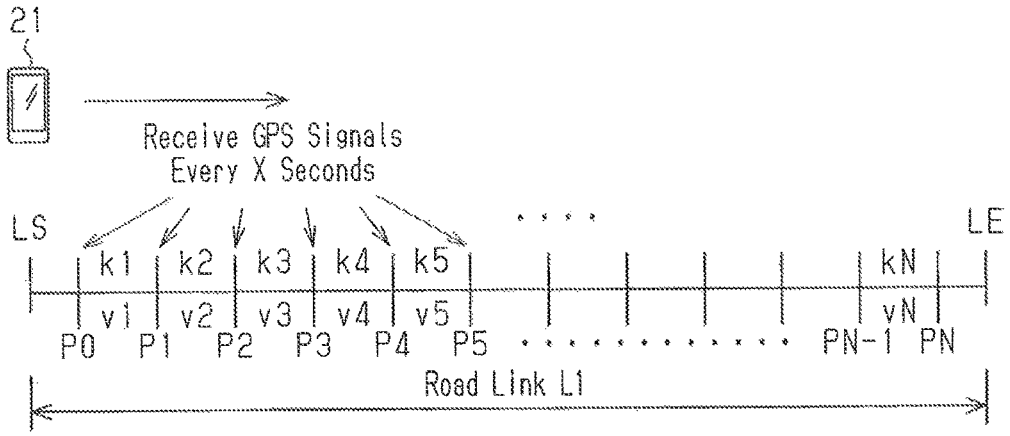
FIG. 2 is a schematic diagram illustrating a road link and a range in which velocity is calculated according to the first embodiment.
Figure 3:
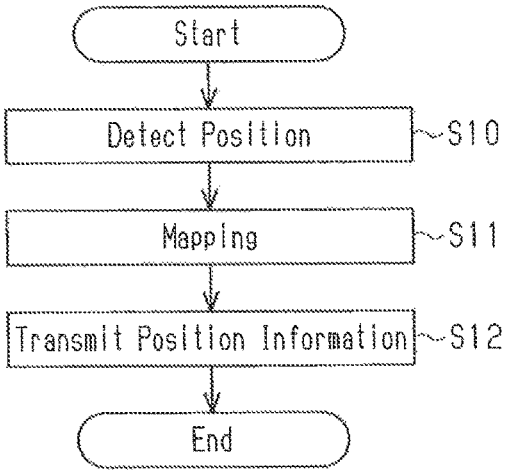
FIG. 3 is a flowchart illustrating the flow in which a mobile information device processes position information according to the first embodiment.

As illustrated in FIG. 3, the mobile information device 21 receives the GPS signal 20 every predetermined time interval and detects the present position information based on the received GPS signal 20 (step S10 in FIG. 3). Moreover, the mobile information device 21 detects the time information of the time at which the position information is detected. When the predetermined time interval elapses, the time interval being measured returns to 0 and measurement of the next elapsed time starts. The mobile information device 21 detects a road link corresponding to the position information by mapping the position information and a corresponding road link (step S11 in FIG. 3). The mobile information device 21 transmits the detected position information, time information, and link information to the center 40 (step S12 in FIG. 3). In this way, a series of operations of detecting the present position information and the like and transmitting the detected information to the center 40 after receiving the GPS signal 20 ends. After that, each time corresponding to the predetermined time interval, the mobile information device 21 repeatedly receives the GPS signal 20 to detect the position information, the detection time, and the link information and transmits the detected information to the center 40. For example, as illustrated in FIG. 2, the position information P0, P1, P2, P3, P4, P5, . . . , and PN are sequentially detected from the GPS signal 20 received every X seconds. Since the detected position information P0, P1, P2, P3, P4, P5, . . . , and PN is between the starting point LS and the ending point LE of the road link L1, the position information is correlated with the road link L1 by mapping.

Operation of the center 40 will now be described with reference to FIGS. 4 to 6.

Figure 4:
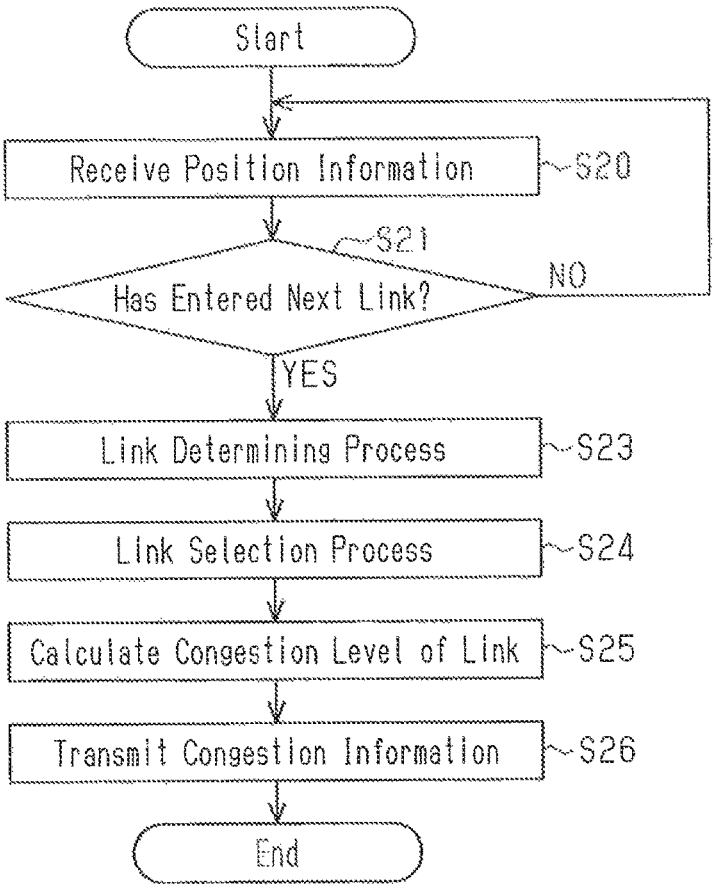
FIG. 4 is a flowchart illustrating the flow in which a center generates congestion information according to the first embodiment.
Figure 5:
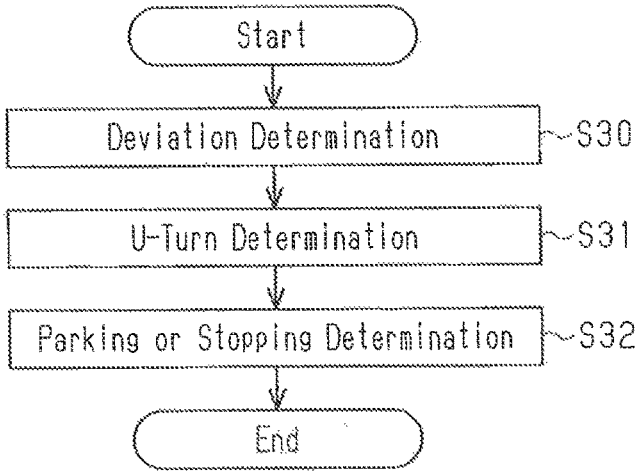
FIG. 5 is a flowchart illustrating the flow in which a center determines whether position information is disconnected in the middle of a road link according to the first embodiment.

The center 40 acquires the position information and the like from the mobile information device 21 by using the information acquiring section 41 (step S20 in FIG. 4). The information acquiring section 41 maintains the acquired position information in the storage section 50 as the acquisition information 52 serving as the information of each mobile information device 21. Moreover, the information acquiring section 41 determines whether a road link corresponding to the present position information acquired from the mobile information device 21 is different from a road link corresponding to previously acquired position information (step S21 in FIG. 4). That is, if the current road link is different from the previous road link, it indicates that the mobile information device 21 has entered the next road link. If the current road link is not different from the previous road link, it indicates that the mobile information device 21 has not entered the next road link. When it is determined that the current road link is not different from the previous road link (step S21 in FIG. 4: NO), since the center 40 further acquires the position information and the like of the road link, the flow returns to step S20 to acquire the next position information and the like from the mobile information device 21.

On the other hand, when the current road link is different from the previous road link (step S21 in FIG. 4: YES), the center 40 performs a link determining process for determining the road link by using the link determining section 43 (step S23 in FIG. 4). The road link is determined when the mobile information device runs through without leaving in the middle of the previous road link and is not determined when the mobile information device leaves in the middle of the previous road link without running through. That is, when the previous road link can be determined, it is inferred that the movement behavior of a moving object is normal. When the previous road link cannot be determined, it is inferred that the movement behavior of the moving object is abnormal. Thus, although not illustrated in the drawing, when the previous road link cannot be determined, the center 40 terminates the process for generating the congestion information of the previous road link and performs a process for generating congestion information of the next road link.

The link determining section 43 determines the road link on condition that the velocity is calculated based on all pieces of position information in the road link, in which the velocity is to be calculated, for example.

For example, in the link determining process, the link determining section 43 acquires a section velocity calculated by the velocity calculator 42 of each section defined between the position information closest to the starting point of the previous road link and the position information closest to the ending point of the previous road link. As illustrated in FIG. 2, a section velocity v1 of a section k1 defined by two pieces of position information P0 and P1 is calculated based on the position information P0 and P1, and a section velocity v2 of a section k2 defined by two pieces of position information P1 and P2 is calculated based on the position information P1 and P2. After that, similarly, the velocity calculator 42 sequentially calculates a section velocity of a section defined by two pieces of position information to calculate a section velocity vN of a section kN defined by two pieces of position information PN−1 and PN based on the position information PN−1 and PN. The link determining section 43 determines the previous road link on condition that the respective section velocities v1 to vN are properly calculated for all the sections k1 to kN. It is estimated that the road link determined herein is the road link along which the mobile information device is moving with movement of the automobile 11 by being carried by an occupant of the automobile 11.

When the road link is determined, the center 40 performs a road link selecting process by using the link selector 44 (step S24 in FIG. 4). The road link selecting process is a process for selecting a road link of which the congestion information is generated among the determined road links. In the present embodiment, it is determined whether the road link is suitable for generation of congestion information based on the section velocity included in the road link. Thus, a road link suitable for generation of congestion information is selected from the determined road links. In other words, a road link that is not suitable for generation of congestion information is excluded from the determined road links.

More specifically, the link selector 44 determines whether it is suitable to generate the congestion information of a road link based on the position information and the time information obtained from the mobile information device 21 based on the section velocity calculated for each section in the road link.

For example, as illustrated in FIG. 2, the link selector 44 acquires section velocities v1 to vN calculated by the velocity calculator 42. The section velocities v1 to vN of the sections k1 to kN of the road link L1 are calculated based on the position information P0 to PN and the time information obtained from the mobile information device 21. The link selector 44 determines whether the position information and the time information obtained from the mobile information device 21 are suitable for generation of the congestion level based on the calculated section velocities v1 to vN of the respective sections k1 to kN.

Figure 6:
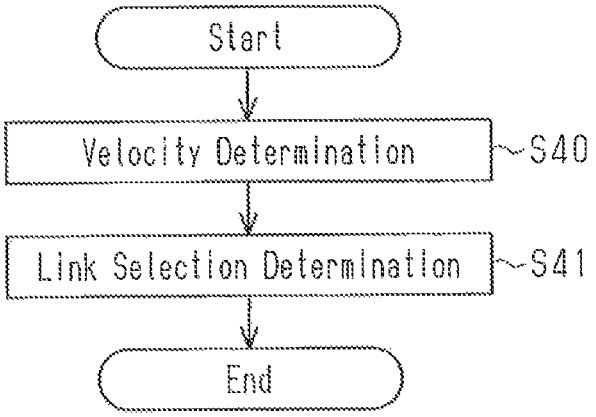
FIG. 6 is a flowchart illustrating the flow of a process for selecting a road link in which the velocity of an automobile is obtained according to the first embodiment.

As illustrated in FIG. 6, when the link selecting process (step S24 in FIG. 4) starts, the link selector 44 determines whether the section velocities of all the sections of the road link are lower than a predetermined lowest velocity vmin in a velocity determination process (step S40). Moreover, the link selector 44 selects a road link having a velocity suitable for generation of congestion information based on the velocity determination result in a link selection determination process (step S41 in FIG. 6). That is, a road link in which the section velocities of all the sections are determined to be lower than the lowest velocity vmin in the velocity determination is excluded from road links to be selected as subject road links for generation of congestion information, and the congestion information of the road link is not generated. For example, the walking velocity of the pedestrian 10 is set to the lowest velocity vmin. Thus, when the information of the road link is information acquired from the mobile information device 21A of the pedestrian 10, the congestion information of the road link is not generated.

Thus, it is determined for the respective mobile information devices 21 whether the velocity calculated for the road link L1 will be used for generation of the congestion level. When it is determined that the velocity is suitable for generation of the congestion level, the congestion level of the road link is generated based on the link velocity calculated for the road link L1.

Subsequently, the center 40 calculates the congestion level of the road link by using the congestion information generator 45 (step S25 in FIG. 4). Only one congestion level of the road link may be generated for each road link.

For example, as illustrated in FIG. 2, the congestion information generator 45 acquires the link velocity of a road link. The link velocity of the road link is calculated by the velocity calculator 42 based on the position information P0 to PN and the time information obtained from the mobile information device 21. The link velocity of the road link L1 is calculated by the velocity calculator 42 based on the position information P0 and the time information closest to the starting point LS of the road link L1 and the position information PN and the time information closest to the ending point LE of the road link L1.

For example, when one congestion level is generated for a road link, the congestion level may be generated based on an average velocity calculated from the section velocities of all the sections or a velocity calculated based on two pieces of position information P0 and PN. Moreover, as illustrated in FIG. 2, the congestion levels of the respective sections k1 to kN may be generated based on the section velocities v1 to vN of the respective sections k1 to kN.

How the congestion level of a road link is generated from the link velocity will now be described with reference to FIG. 2.

An entire section distance of the sections k1 to kN is calculated from the difference in distance between the two pieces of position information P0 and PN. The required time is calculated from the difference between the time information detected at the position information P0 and the time information detected at the position information PN. The average velocity of the sections k1 to kN is calculated by an expression (section distance)/(required time). The congestion level is generated based on the average velocity calculated in this manner. In the present embodiment, the congestion level is classified into three ranks using two thresholds α and β. The thresholds α and β are values indicating specific velocities and have a relation of (threshold α)<(threshold β). For example, the threshold α is 10 km/h and the threshold β is 20 km/h. The three ranks are set as heavy congestion, light congestion, and smooth. Moreover, a determination subject average velocity is classified into three ranks by a combination of the thresholds α and β. That is, the congestion level is determined to be heavy congestion when (average velocity)<(threshold α), the congestion level is determined to be light congestion when (threshold α)≤(average velocity)<(threshold β), and the congestion level is determined to be smooth when (threshold β)≤(average velocity).

When the congestion levels of one road link are generated based on pieces of information acquired from the plurality of mobile information devices 21, the congestion information generator 45 may adjust the congestion levels to calculate the congestion level of the road link. Moreover, the congestion information generator 45 may arbitrarily select two pieces of position information and generate the congestion level of a road link based on a section defined by the arbitrarily selected position information.

When the congestion level is generated, the center 40 transmits the congestion information by using the information providing section 46 (step S26 in FIG. 4). The automobile 11 receives the congestion information transmitted in this manner via the communication section 30, and the real-time congestion information is provided to the occupant of the automobile such as the driver via the navigation device 22 or the like.

Hereinafter, the link determining process (step S23 in FIG. 4) will be described in detail with reference to FIG. 5. As described above, although a process for determining the road link on condition that the velocity in a road link is calculated is performed in the link determining process, a process described below is also performed in the link determining process.

The center 40 performs a deviation determination process (step S30 in FIG. 5), a U-turn determination process (step S31 in FIG. 5), and a parking or stopping determination process (step S32 in FIG. 5) as the link determining process by using the link determining section 43.

In the deviation determination process (step S30), it is determined that respective pieces of position information indicate that a mobile information device has deviated from a road link by entering an alley in the middle of a road link, and the congestion information is not generated for the road link having the position information that is determined to indicate the deviation from the road link. For example, when respective pieces of position information are acquired per second and then upper limit velocity is restricted to 60 km/h in a road, the largest interval between the respective pieces of position information is approximately 17 meters (m). Thus, when the last position information of a road link is at a position separated by 17 meters+q (q is a determination margin) from the ending point of the road link, it is determined that a mobile information device has deviated from a road link. The purpose of deviation determination is to identify information that is not suitable for generation of congestion information rather than determining whether the mobile information device 21 has actually deviated from a road link. Thus, the deviation determination may determine the lack of position information occurring due to power-off or troubles of the mobile information device 21, for example, in addition to a state in which the mobile information device 21 deviates from a road link.

In the U-turn determination process (step S31), it is determined that respective pieces of position information indicate that a mobile information device has made a U-turn (turn around) as a change of direction in a road link, and the congestion information is not generated for a road link having the position information indicating the U-turn made in a road link. For example, when a movement path formed by the respective pieces of position information draws a locus that returns in a reverse direction in the middle of a road link, it is determined that a mobile information device has made a U-turn. A road link is often set between connection points of a road, and the automobile 11 rarely changes its moving direction in the middle of a road link. Thus, the pieces of position information that change its moving direction in the middle of a road link are determined to be not suitable for generation of congestion information since such pieces of position information do not indicate at least a normal travel mode. The purpose of U-turn determination is to identify information that is not suitable for generation of congestion information rather than determining whether the mobile information device 21 has actually made a U-turn in a road link. Thus, the U-turn determination may determine a change in direction of the pedestrian 10, a backward movement of the automobile 11, and the pedestrian 10 getting on and off the automobile 11 in a road link, for example, in addition to a state in which the mobile information device 21 makes a U-turn in a road link.

In the parking or stopping determination process (step S32), it is determined that respective pieces of position information indicate that a mobile information device has stopped or parked for a predetermined period or more in a road link, and the congestion information is not generated for the road link having such pieces of position information determined to indicate stopping or parking in a road link. For example, when a period in which the velocity is 0 continues for a predetermined period or more in a road link, it is determined that a mobile information device has stopped or parked. The purpose of the parking or stopping determination is to identify information that is not suitable for generation of congestion information rather than determining a state in which the mobile information device 21 has actually stopped or parked in a road link. Thus, the parking or stopping determination may determine the stopping of the pedestrian 10, for example, in addition to a state in which the mobile information device 21 has stopped or parked in a road link.

That is, the deviation determination, the U-turn determination, and the parking or stopping determination correspond to a state in which a section velocity in a road link is interrupted in the middle of the road link when the link velocity of the road link is calculated.

The section velocity may be calculated first, and the deviation determination, the U-turn determination, and the parking or stopping determination may be made based on the calculated section velocity. For example, the deviation determination can be made by determining whether the velocity is interrupted in the middle of a road link, the U-turn determination can be made by determining whether the direction of the section velocity is changed, and the parking or stopping determination can be made by determining whether a period having the section velocity of zero continues for a predetermined period.

As described above, according to the present embodiment, the accuracy of the road congestion information generated based on information obtained from the mobile information device 21 may be improved. The embodiment described above may achieve the advantages listed below.

(1) Since the mobile information devices 21 are held by the pedestrian 10, the occupant of the automobile 11, the passenger of the train 12, and the like, it may not be said that the position information and the time information obtained from the mobile information device 21 are obtained from the automobile 11 only that is suitable as the subject of congestion information. That is, when the congestion information is generated while including a velocity based on information obtained from a moving object other than the automobile 11 including the pedestrian 10, the accuracy of the congestion information may be also low. In this respect, in the present embodiment, whether the link velocity of a road link will be used for generation of congestion information is determined based on the section velocity of each section in the road link for the respective mobile information devices 21. Thus, the link velocity based on the position information and the time information obtained from the mobile information device 21 that is not suitable for generation of congestion information is excluded, and the possibility may be increased that the position information and the time information have been obtained from the mobile information device 21 that is suitable for generation of the congestion level. Thus, the accuracy of the congestion information generated from the velocity based on the information obtained from the mobile information device 21 may be improved.

(2) A condition that all the section velocities calculated in one road link are less than or equal to a predetermined value is employed in the present embodiment. Thus, for example, since a case in which the velocity is lower than the velocity of the pedestrian 10 is excluded, the possibility may be increased that the link velocity has been obtained from the mobile information device that is suitable for generation of congestion information.

Moreover, when the section velocity calculated in a road link is outside a predetermined velocity range of which the lower limit is the lowest velocity vmin, the link velocity of the road link is not used for generation of the congestion information. Due to this, it is possible to easily and adequately exclude a link velocity that is not suitable for generation of congestion information, such as the link velocity of a moving object other than the automobile 11, from the link velocity calculated from the information obtained from the mobile information device 21.

(3) The link velocity between two pieces of position information closest to the starting point LS and the ending point LE of a road link is calculated. Since the position information that is suitable for calculation of the link velocity in a road link is selected, the congestion information that may be suitable for the road link is generated.

(4) Since the automobile 11 generally moves along the road link from the starting point LS to the ending point LE, in the present embodiment, the section velocities in the respective sections of the road link are calculated based on all the pieces of position information and time information. By doing so, the possibility may be increased that the position information and the time information of the road link are based on the movement of the automobile 11. In this way, since the possibility may be increased that the moving object is the mobile information device 21 of the automobile 11 suitable for calculation of the congestion information, it may be possible to maintain the accuracy of the congestion information of the road link.

(5) Since entry to an alley in the middle of a road link, a change in direction, and stopping or parking for a predetermined period or more is a movement that is clearly different from a normal travel mode, when such a movement is detected in a road link, the velocity in the road link is not used for generation of the congestion information. By doing so, it may be possible to maintain the accuracy of congestion information.

Second Embodiment

A congestion information generation device and a congestion information generation method according to a second embodiment will now be described with reference to FIGS. 7 to 9. The second embodiment is different from the first embodiment in the link selecting process. Accordingly, differences from the first embodiment will mainly be discussed.

Figure 7:
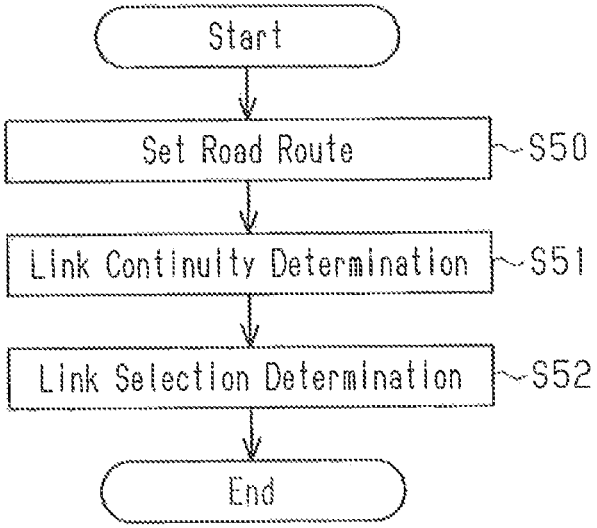
FIG. 7 is a flowchart illustrating the flow of a process for determining the continuity of a road link in which the velocity is obtained by a congestion information generation device according to a second embodiment.

As illustrated in FIG. 7, in the present embodiment, the link selecting process (step S24 in FIG. 4) includes a road route setting process (step S50 in FIG. 7), a link continuity determination process (step S51 in FIG. 7), and a link selection determination process (step S52 in FIG. 7) in addition to or instead of the velocity determination and link selection determination processes (steps S40 and S41 in FIG. 6).

In the road route setting process (step S50), a route on a road following the road is selected based on the road link on which the position information is mapped. That is, the second sequence as the sequence of road links corresponding to the selected road route is identified. That is, the route selected in this manner is set as a route along which the automobile 11 travels.

In the link continuity determination process (step S51), first, the first sequence is identified, which is the sequence of the latest road link determined based on the position information acquired from a specific mobile information device 21 and the previous road link determined earlier than the latest road link. Subsequently, in the link continuity determination, the first sequence, which is the sequence of the latest road link and the previous road link, is compared with the second sequence, which is the sequence of road links following the route on roads set in the road route setting process, and it is determined whether the two road link sequences are the same or different.

In the link selection determination process (step S52), when the comparison result in the link continuity determination process indicates "same", the road link is selected as the congestion information generation subject. On the other hand, when the comparison result indicates "different", the road link is not selected as the congestion information generation subject. Thus, the link velocity calculated for the road link is not used for generation of congestion information.

However, the automobile 11 generally moves along respective road links in a sequence following the road. As described above, the comparison result indicating that the two sequences are "different" is obtained when the moving object moves along a route other than a road such as a river and a sea, a canal, the sky, a field, a mountain, or an exclusive track. Examples of such a moving object include a large or small ship, a drone, an air plane, a helicopter, a horse, a racing car, a leisure vehicle, a farming vehicle, a heavy industrial machine, and a train. According to such a moving object, even when the road link is determined, the first sequence of the road link determined in this manner is not used as the sequence of the road route. Thus, the velocity of a road link, calculated based on the mobile information device 21 moving together with a moving object other than the automobile 11 is not used for generation of congestion information.

The flow of determination when the first sequence of road links obtained from a moving route of a moving object is different from the second sequence of road links following the route on a road and the moving object is the train 12 will be described with reference to FIGS. 8 and 9. In FIG. 9, an example will be described in which the mobile information device 21A carried by the pedestrian 10, the mobile information device 21B carried by the occupant of the automobile 11, and the mobile information device 21C carried by the passenger of a train are distinguished, and the mobile information devices are selected or not as the congestion information generation subject based on such a classification.

Figure 8:
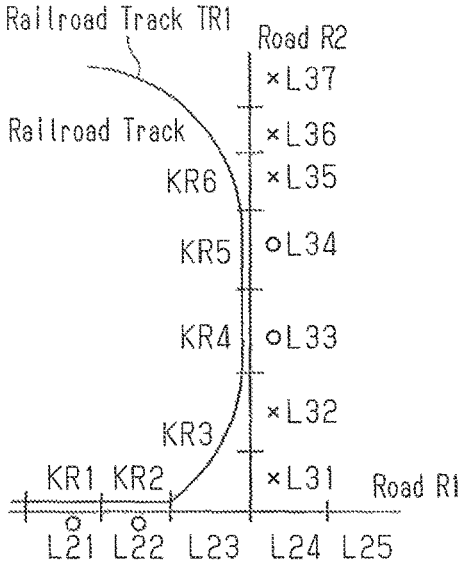
FIG. 8 is a schematic diagram illustrating a case in which there is no continuity of a road link in which the velocity is obtained according to the second embodiment.

As illustrated in FIG. 8, it is assumed that sections KR1 and KR2 of a railroad track TR1 of the train 12 extend in parallel with a road R1, sections KR4 and KR5 extend in parallel with a road R2, and the other sections KR3 and KR6 do not extend in parallel with any road. In this case, the position information of the mobile information device 21C carried by a passenger of the train 12 travelling along the railroad track TR1 is correlated with a road link L21 by matching when moving through the section KR1 and the information thereof is correlated with a road link L22 by matching when moving through the section KR2. Subsequently, the position information is not correlated with any road link by matching when moving through the section KR3. Subsequently, the position information is correlated with a road link L33 by matching when moving through the section KR4, and the position information is correlated with a road link L34 by matching when moving through the section KR5. The position information is not correlated with any road link by matching when moving through the section KR6. In this way, the position information, the time information, and the link information obtained from the mobile information device 21C moving along the railroad track TR1 are stored in the center 40 as acquisition information as needed. That is, the first sequence of road links obtained based on the position information of the mobile information device 21C is the road links L21, L22, L33, and L34. Moreover, since this road link sequence has the sections KR3 and KR6, which are not allocated to the road link, the road link sequence does not include a road link that is to be connected between the road link L22 and the road link L33 and a road link that is to be connected to the road link L34. On the other hand, the second sequence of road links obtained according to the route on a road in a road route set to include the road links L21, L22, L33, and L34 in the route is the road links L21, L22, L23, L31, L32, L33, L34, L35, and L36.

Next, an example of the link selection determination process (step S52) will be described with reference to FIG. 9.

The center 40 identifies the road link corresponding to the position information and the like acquired from the mobile information device 21 and calculates the section velocity of the identified road link. Moreover, the center 40 determines a road link serving as a congestion information generation subject based on the calculated section velocity (step S60 in FIG. 9). The link selector 44 of the center 40 determines whether all the section velocities in the determined road link are less than or equal to X km/h (step 361 in FIG. 9). In the present embodiment, X km/h is set to a value that is considered to be the walking velocity of a pedestrian such as 6 km/h. Thus, a velocity less than or equal to X km/h is highly likely to indicate that the moving object is the pedestrian 10 and is not the automobile 11. When all the section velocities in the determined road link are less than or equal to X km/h (step S61 in FIG. 9: YES), the link selector 44 stops generating the congestion level of the road link based on the link velocity of the road link. Thus, the road link is not selected as the congestion level generation subject (step S62 in FIG. 9). From the fact that the section velocity is less than or equal to X km/h (6 km/h), it can be estimated that the acquired position information and the like are acquired by the mobile information device 21A carried by the pedestrian 10. After that, the link selection determination process ends.

Figure 9:
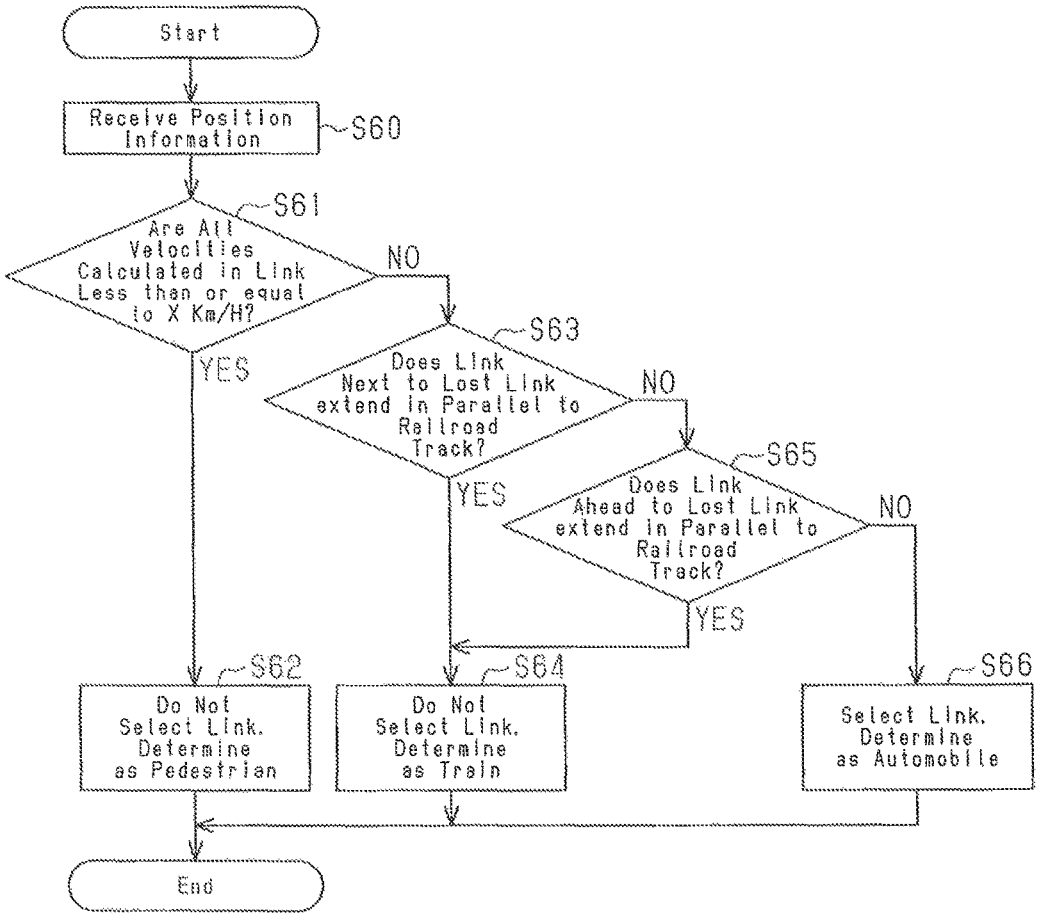
FIG. 9 is a flowchart illustrating the flow of a process for identifying walking, a train, and an automobile from the velocity obtained for a road link according to the second embodiment.

In contrast, when all the section velocities in the determined road link are less than or equal to X km/h (step S61 in FIG. 9: NO), and when "a road link correlated with position information" is present next to a "section in which position information is not correlated with a road link (a section in which the link is lost)", the link selector 44 determines whether the road link extends in parallel with the railroad track TR1 (step S63 in FIG. 9). When it is determined that the road link extends in parallel with the railroad track TR1 (step S63 in FIG. 9: YES), the link selector 44 does not generate a congestion level for the road link determined based on the section velocity. Thus, the road link is not selected as the congestion level generation subject (step S64 in FIG. 9). That is, if a condition is satisfied that, although the position information indicates that a moving object is moving, a road link is not identified from the position information, and a road link identified from the next position information extends in parallel with the railroad track TR1, it can be estimated that the position information has been acquired by the mobile information device 21C carried by the passenger of the train 12 such as an electric train. After that, the link selection determination process ends.

When it is determined that the road link does not extend in parallel with the railroad track TR1 (step S63 in FIG. 9: NO), and when a "road link correlated with position information" is present ahead even if two or more "sections in which position information is not correlated with a road link (sections in which the link is lost)" are present, it is determined whether the road link extends in parallel with the railroad track TR1 (step 965 in FIG. 9). When it is determined that the road link extends in parallel with the railroad track TR1 (step S65 in FIG. 9: YES), the link selector 44 stops generating the congestion level of the road link determined based on the section velocity. Thus, the road link is not selected as the congestion level generation subject (step S64 in FIG. 9). After that, the selection process ends.

On the other hand, when it is determined that the road link does not extend in parallel with the railroad track TR1 (step S65 in FIG. 9: NO), the link selector 44 selects the road link determined based on the section velocity as the congestion level generation subject (step 966 in FIG. 9). Moreover, since the possibility is high that the person carrying the mobile information device 21 is not the pedestrian 10 or the passenger of the train 12, it can be estimated that the mobile information device 21 is the mobile information device 21B of the occupant of the automobile 11.

In addition to the advantages (1) to (5) of the first embodiment, the congestion information generation device and the congestion information generation method according to the present embodiment achieve the advantages listed below.

(6) The automobile 11 may generally move along road links in the sequence following the road route. Thus, the link velocities of road links in which the first sequence of the determined road links is not aligned according to the second sequence of road links following the road route are not used for generation of congestion information. By doing so, it is possible to reduce the possibility that the link velocity of a moving object other than the automobile 11 will be used for generation of congestion information. For example, the road links determined by the moving route of a moving object moving along a route other than a road such as a river and a sea, a canal, the sky, a field, a mountain, or an exclusive track are not aligned according to the second sequence that follows a road route.

(7) The roads R1 and R2 may extend in parallel with the railroad track TR1. However, when the determined road link is connected to a non-determined road link and extends along the railroad track TR1, there is a possibility that the mobile information device has moved along a railroad track. Thus, the link velocity of the determined road link, which is not suitable for generation of congestion information, is not used for generation of congestion information. A non-determined road link includes one or a plurality of pieces of position information by which a road link cannot be determined.

The second embodiment may be combined with the first embodiment.

Third Embodiment

A congestion information generation device and a congestion information generation method according to a third embodiment will now be described with reference to FIGS. 10 and 11.

The present embodiment is different from the first embodiment in terms of how the position information corresponding to the ending point of a road link is identified. Accordingly, difference from the first embodiment will mainly be discussed.

Figure 10:
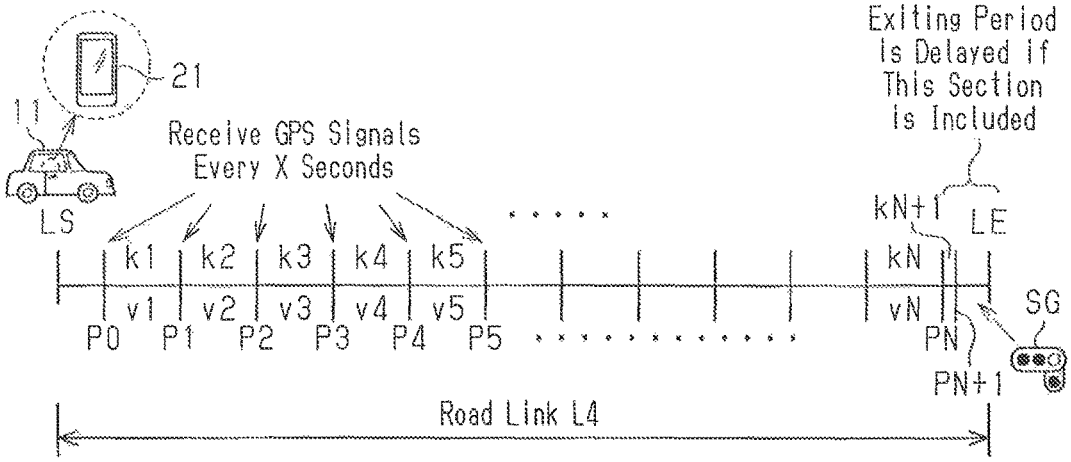
FIG. 10 is a schematic diagram illustrating how the velocity used for generating the congestion level of a road link is selected by a congestion information generation device according to a third embodiment.

As illustrated in FIG. 10, in the present embodiment, the mobile information device 21 of the automobile 11 acquires position information P0, P2, . . . , and PN+1 and these pieces of position information are correlated with a road link L4 by mapping. The position information P0 is selected as the position information closest to the starting point LS of the road link L4. On the other hand, the position information PN+1 is the position information closest to the ending point LE of the road link L4. However, it is assumed that a traffic signal SG is located between the ending point LE of the road link L4 and the position information PN+1, and the row of a plurality of automobiles 11 stopping according to the traffic signal SG indicating stop extends over the position information PN+1. That is, since the position information PN+1 closest to the ending point LE of the road link L4 includes the stopping period due to the traffic signal SG, if the congestion level is generated for the road link including the section between the position information PN+1 and the ending point LE, the generated congestion level includes a delay corresponding to the period for exiting the link. Thus, the congestion level of a road link generated based on the link velocity in which the stopping period due to the traffic signal SG is reflected has low accuracy, and a driver may feel a sense of incongruity.

Thus, in the present embodiment, the position information and the time information closest to the ending point LE of the road link L4, which is used for generation of the congestion level, are determined while excluding position information and time information within a predetermined distance greater than or equal to the length of a row of automobiles stopping due to the traffic signal SG from the ending point LE of the road link L4. For example, in the present embodiment, the position information PN+1 within the predetermined distance from the ending point LE of the road link L4 is excluded, and the position information PN located further from the predetermined distance is determined as the position information and the time information closest to the ending point LE of the road link L4. Thus, the congestion level of the road link L4 is generated based on the link velocity excluding the section velocity of the section kN+1, in which the influence of the traffic signal SG is not avoidable, among the sections k1 to kN+1 of the road link L4. Thus, the accuracy of the congestion level may be improved.

Figure 11:
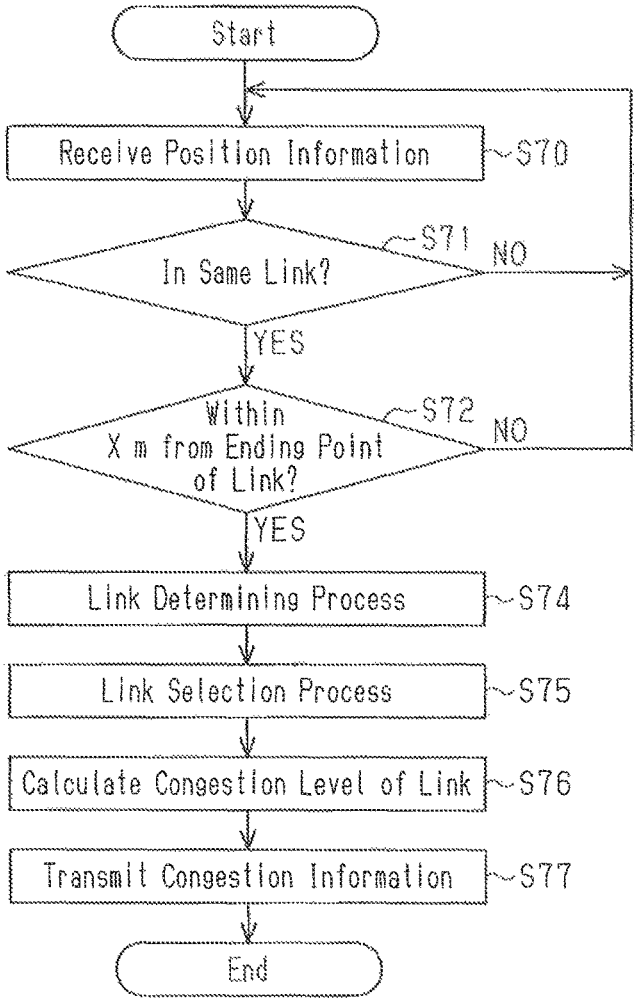
FIG. 11 is a flowchart illustrating the flow of a process for generating the congestion level of a road link based on the selected velocity according to the third embodiment.

As illustrated in FIG. 11, the information acquiring section 41 of the center 40 acquires the position information and the like from the mobile information device 21 (step S70 in FIG. 11). The link determining section 43 of the center 40 determines whether the present position information is in the same road link as the previous position information (step S71 in FIG. 11). When it is determined that the previous position information and the present position information are not in the same road link (step S71 in FIG. 11: NO), the center 40 returns to the flow to step S70 so that the information acquiring section 41 acquires the position information and the like. On the other hand, when it is determined that the previous position information and the present position information are in the same road link (step S71 in FIG. 11: YES), the center 40 determines whether the position information is within a predetermined distance X m from the ending point LE of the road link (step S72 in FIG. 11). The predetermined distance X m is a value set for each ending point LE (for example, for each traffic signal SG) of the road link and may be a predetermined value and may be a value changing depending on the date and the traffic condition. When it is determined that the position information is not within the predetermined distance X m from the ending point LE of the road link (step S72 in FIG. 11: NO), the center 40 further acquires the position information of the road link. Thus, the flow returns to step S70, and the information acquiring section 41 acquires the position information and the like. On the other hand, when it is determined that the position information is within the predetermined distance X m from the ending point LE of the road link (step S72 in FIG. 11: YES), the center 40 excludes the present position information and determines the previous position information as the position information corresponding to the ending point LE of the road link. The link velocity is calculated based on the pieces of position information corresponding to the starting point and the ending point of the road link, determined in this manner. For example, the section velocities v1 to vN are calculated for the sections k1 to kN between the position information P0 corresponding to the starting point of the road link and the position information PN corresponding to the ending point. Moreover, it is determined whether the link velocity is suitable for generation of the congestion level based on the section velocity calculated in this manner, and the congestion level of the road link is generated (steps S74 to S77 in FIG. 11). Since the processes of steps S74 to S77 in FIG. 11 are the same as the processes of steps S23 to S26 in FIG. 4 described in the first embodiment, the detailed description thereof will not be provided for the sake of convenience. In addition to the advantages (1) to (5) of the first embodiment, the congestion information generation device and the congestion information generation method according to the present embodiment achieve the following advantage.

(8) The ending point, which is the end of a road link, may be a connection point or the like of a plurality of roads and a traffic signal SG and various restrictions are present at the ending point. Thus, such an ending point may not be suitable for generation of the congestion information. Thus, by calculating the link velocity by excluding the position information and the time information within a predetermined distance from the starting point LS or the ending point LE of the road link, it is possible to improve the accuracy of the congestion information.

The third embodiment may be combined with at least one of the first and second embodiments.

Fourth Embodiment

A congestion information generation device and a congestion information generation method according to a fourth embodiment will now be described with reference to FIGS. 12 and 13.

The present embodiment is different from the first embodiment in that the link selection process includes a function dealing with erroneous matching of road links. Differences from the first embodiment will be mainly discussed.

Figure 12:
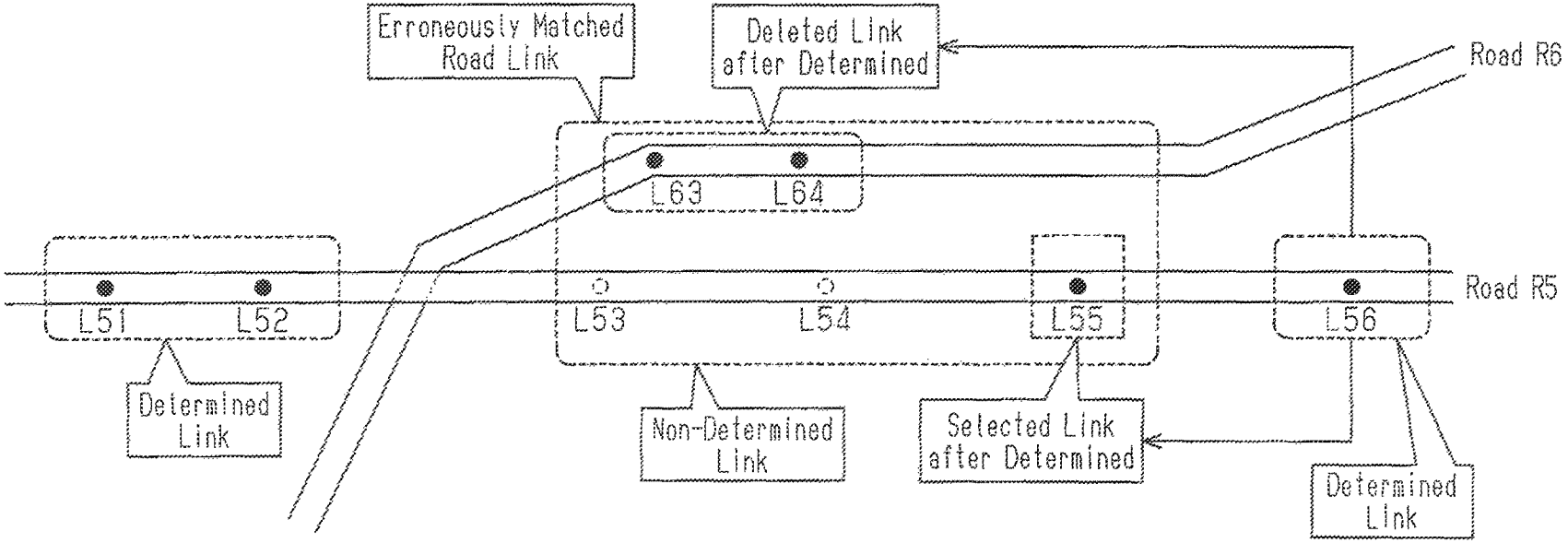
FIG. 12 is a schematic diagram illustrating how road links on which the position information is mapped are corrected and deleted by a congestion information generation device according to a fourth embodiment.

As illustrated in FIG. 12, it is assumed that a portion of a route extends in parallel with an expressway R5 and a general road R6, and the automobile 11 is travelling along the expressway R5. The occupant of the automobile 11 carries the mobile information device 21B, and the position information, the time information, and the link information transmitted from the mobile information device 21B are transmitted to the center 40. The center 40 generates congestion information for the corresponding road link based on the received position information, time information, and link information. In the present embodiment, the roads extending in parallel with a portion of a route include an expressway and a general road. However, the roads extending in parallel with a portion of a route may be expressways only, general roads only, and such a combination of a main road and a side road, for example, in which the roads are connected by a gateway or a communication way as long as the roads are in parallel with a portion of a route. The number of roads parallel with a portion of a route may be three or more.

In the present embodiment, the mobile information device 21 detects the position information based on the GPS signal 20. The position information detected from the GPS signal 20 includes some errors. When the GPS signal 20 only is used, a position error of several 100 m at most may occur and the position may not be detected. The mobile information device 21 may include a mechanism for correcting the position information using other satellite signals, terrestrial signals, and the like to increase the detection accuracy or a mechanism for preventing detection errors. The navigation device 22 or the like mounted on the automobile 11 is configured to increase the position accuracy by determining whether the position of the automobile 11 is on a road and correcting the position using information on the travel distance, the velocity, and the like. On the other hand, since the mobile information device 21 has a high degree of flexibility in its destination and it may not be easy to set the priority of the destination, it may be difficult for the mobile information device 21 to detect the position information with accuracy as high as the navigation device 22.

Thus, the mobile information device 21 may map the detected position information on another adjacent road rather than the road along which the device moves due to errors and the like included in the detected position information. For example, as illustrated in FIG. 12, the mobile information device 21 of the automobile 11 travelling along the expressway R5 from left to right in the drawing maps the detected position information on the road links L51 and L52. Subsequently, the mobile information device 21 may map the detected position information on the road links L63 and L64 of the general road R6 along which the device is not travelling rather than the road links L53 and L54 along which the device is actually travelling due to errors included in the detected position information. After that, the mobile information device 21 maps the detected position information on the road links L55 and L56 along which the device is actually travelling since the errors included in the detected position information decrease. The link information mapped in this manner is transmitted from the mobile information device 21 to the center 40.

Figure 13:
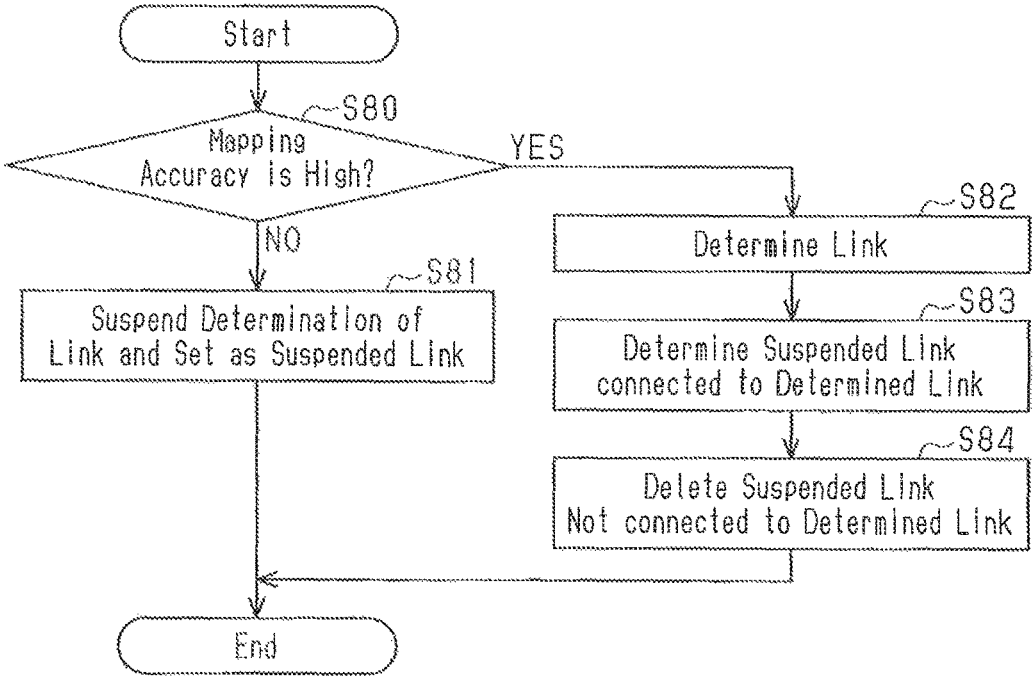
FIG. 13 is a flowchart illustrating the flow of a process for correcting and deleting a road link on which the position information is mapped according to the fourth embodiment.

As illustrated in FIG. 13, the link determining section 43 of the center 40 reflects the accuracy of mapping by the mobile information device 21 mapping the position information on the road link on a road link determining process. The road link determining process may be performed whenever the need to determine the road link arises.

The link determining section 43 determines whether the accuracy of mapping by the mobile information device 21, which maps the position information on the road link, is high for the road link in a determinable state (step S80 in FIG. 13). The mapping accuracy on a road link is determined based on whether a road link having a high possibility of erroneous matching is present near the road link. For example, the mapping accuracy decreases as the distance between the road link and the adjacent road link decreases and the mapping accuracy increases as the distance increases. When it is determined that the mapping accuracy of the road link is not high (step S80 in FIG. 13: NO), the link determining section 43 suspends determination of the road link and maintains the road link as a suspended link (step S81 in FIG. 13) and temporarily ends the road link determining process. For example, with this process, the road links L63, L64, and L55 are classified as the suspended links in FIG. 12.

Subsequently, when a road link in a determinable state is present, the link determining section 43 determines whether the accuracy of mapping by the mobile information device 21, which maps the position information on a road link, is high (step S80 in FIG. 13). In this case, when it is determined that the mapping accuracy on the road link is high (step S80 in FIG. 13: YES), the link determining section 43 determines the road link (step S82 in FIG. 13). Moreover, when a suspended link connected to the determined road link is present, the link determining section 43 determines the suspended link as a road link when the suspended link was suspended (step S83 in FIG. 13). When a suspended link that is not connected to the road link is present, the link determining section 43 deletes the suspended link (step S84 in FIG. 13). In this manner, after the suspended link is determined or deleted, the road link determining process ends temporarily. For example, with this process, the road link L55 classified as the suspended link is determined and the road links L63 and L64 classified as the suspended link are deleted.

In addition to the advantages (1) to (5) of the first embodiment, the congestion information generation device and the congestion information generation method according to the present embodiment achieve the following advantage.

(9) Even when the mobile information device 21 erroneously matches the road link due to position information including errors, the erroneously matched road link is corrected or deleted, whereby the accuracy of congestion information may be maintained.

The fourth embodiment may be combined with at least one of the above described first to third embodiments.

Fifth Embodiment

A congestion information generation device and a congestion information generation method according to a fifth embodiment will now be described with reference to FIG. 14.

The present embodiment is different from the first embodiment in that the congestion information generator 45 has a function of properly correcting the congestion level generated based on a velocity having a calculation error. Differences from the first embodiment will be mainly discussed.

The velocity calculator 42 of the center 40 calculates a link velocity of a road link based on the position information, the time information, and the link information acquired from the mobile information device 21.

Figure 14:
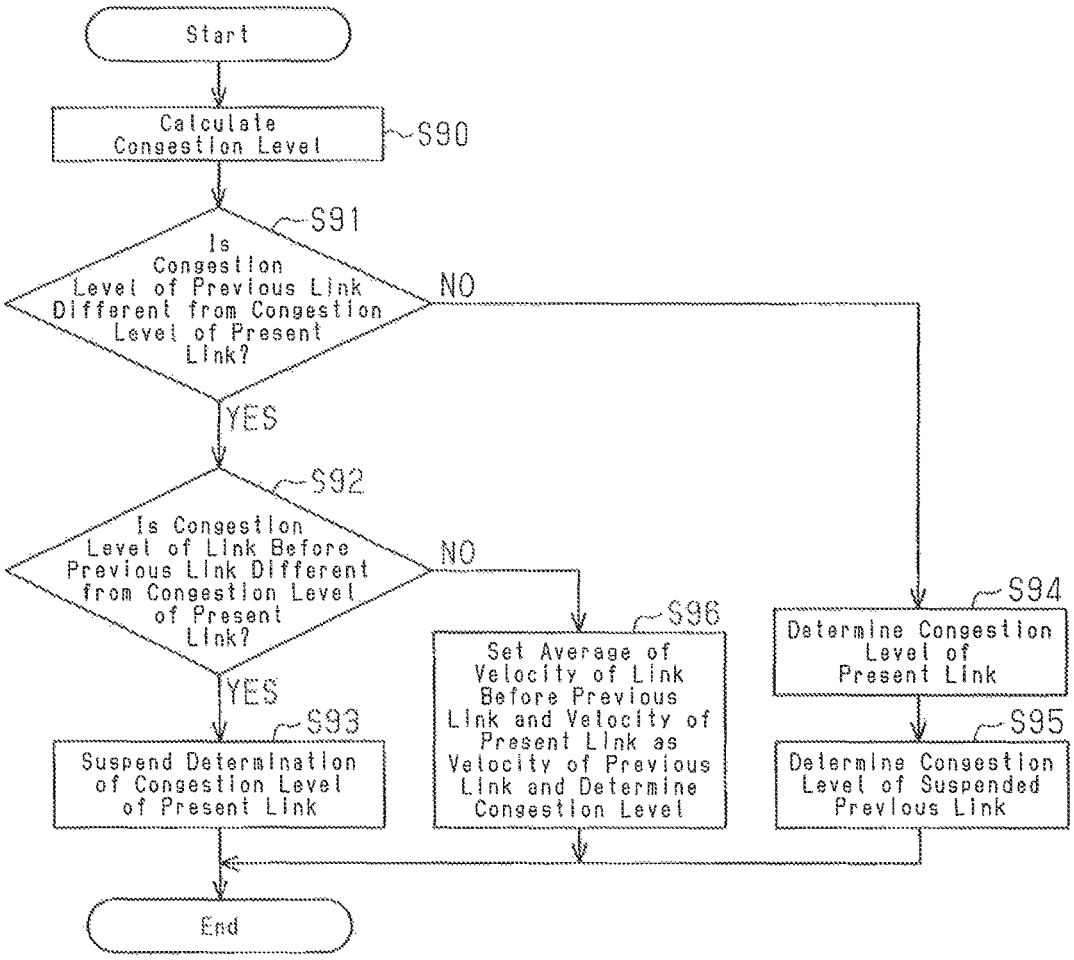
FIG. 14 is a flowchart illustrating the flow of a process for correcting and deleting the velocity calculated for a road link by a congestion information generation device according to a fifth embodiment.

FIG. 14 illustrates a process for correcting a congestion level generated based on a link velocity calculated from position information including errors. In the present embodiment, an example in which this process starts whenever the congestion level is calculated is illustrated. However, the process may be executed every predetermined time interval or may be executed when a plurality of congestion levels is generated.

When the congestion level correction process starts, the congestion information generator 45 of the center 40 calculates the congestion levels of respective road links (step S90 in FIG. 14). The congestion information generator 45 determines whether the congestion level of a previous road link, which is a road link before the current road link, is different from the congestion level of a present road link, which is the current road link (step S91 in FIG. 14). When it is determined that the congestion level of the previous road link is different from the congestion level of the present road link (step S91 in FIG. 14: YES), the congestion information generator 45 determines whether the congestion level of the road link before the previous road link is different from the congestion level of the present road link (step S92 in FIG. 14). When it is determined that the congestion level of the road link before the previous road link is different from the congestion level of the present road link (step S92 in FIG. 14: YES), the congestion information generator 45 suspends the determination of the congestion level of the present road link (step S93 in FIG. 14). After that, the congestion level correction process ends temporarily.

When it is determined that the congestion level of the road link before the previous road link is not different from the congestion level of the present road link (step S92 in FIG. 14: NO), the congestion information generator 45 sets the average of the velocity of the road link before the previous road link and the velocity of the present road link as the velocity of the previous road link and determines the congestion level of the previous road link based on the velocity of the previous road link (step S96 in FIG. 14). After that, the congestion level correction process ends temporarily.

When it is determined that the congestion level of the previous road link is not different from the congestion level of the present road link (step S91 in FIG. 14: NO), the congestion information generator 45 determines the congestion level of the present road link (step S94 in FIG. 14) and determines the congestion level of the previous section in which the determination of the congestion level is suspended (step S95 in FIG. 14).

Thus, it is possible to properly correct the congestion level generated based on the link velocity calculated from the position information including errors, which may improve the accuracy of the congestion level. In addition to the advantages (1) to (5) of the first embodiment, the congestion information generation device and the congestion information generation method according to the present embodiment achieve the following advantage.

(10) The mobile information device 21 detects position information while including errors. It is possible to properly correct the congestion level generated based on the link velocity calculated from the position information including errors, which may improve the accuracy of the congestion level.

The fifth embodiment may be combined with at least one of the above described first to fourth embodiments.

Other Embodiments

The above described embodiments may be modified, e.g., as follows.

At least two of the first to fifth embodiments may be combined to form a congestion information generation device.

In each of the above illustrated embodiments, a case is described in which the center 40 acquires the position information and the like from the mobile information device 21. However, the embodiments are not limited thereto, and another mobile information device may acquire the position information and the like from the mobile information device, and the mobile information device that has acquired the information may generate the congestion level.

In each of the above illustrated embodiments, a case is described in which the center 40 includes the information acquiring section 41, the velocity calculator 42, the link determining section 43, the link selector 44, the congestion information generator 45, and the information providing section 46. However, the embodiments are not limited thereto, and the information acquiring section, the velocity calculator, the link determining section, the link selector, the congestion information generator, and the information providing section may be grouped as long as the functions thereof are provided. Alternatively, the functions may be combined and may be segmented.

In each of the above illustrated embodiments, a case is described in which the deviation determination process, the U-turn determination process, and the parking or stopping determination process are included. However, the embodiments are not limited thereto, and the U-turn determination process and the parking or stopping determination process may be omitted, and at least one of the determination processes may be provided. When two or more determination processes are provided, a combination thereof is arbitrary. Thus, when at least one of the determination processes is provided, the road link having information that is not suitable for generation of the congestion information can be excluded more adequately from the road links used for generation of the congestion information.

In the above illustrated embodiments, while the section velocity of each section is calculated, the calculated section velocity may be corrected. By doing so, it is possible to reduce the influence of noise that affects calculation of the velocity like some errors or the like included in the position information detected by the mobile information device 21.

Figure 15:
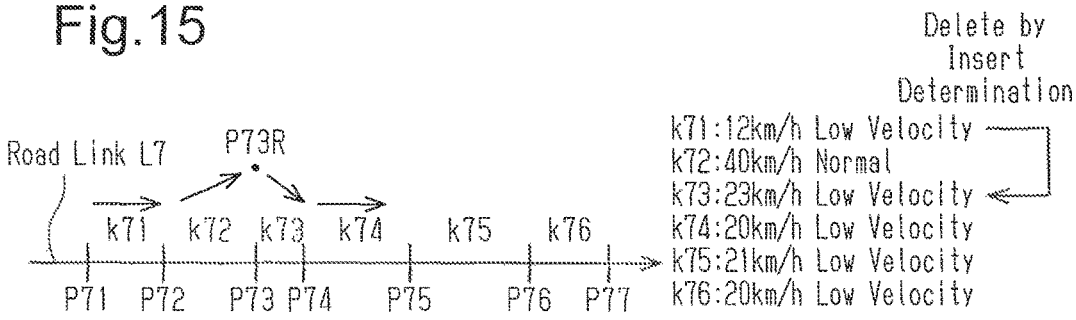
FIG. 15 is a schematic diagram illustrating the velocity calculated based on the position information mapped on a road link by a congestion information generation device according to another embodiment.

FIG. 15 illustrates an example of position information in the road link L7, acquired from the mobile information device 21. Pieces of position information P71 to P77 are obtained from the mobile information device 21, and respective sections k71 to k76 are defined based on the pieces of position information. In this case, it is assumed that the actual position (longitude and latitude) corresponding to the position information P73 is a position P73R, which laterally deviates from the road link L7. As a result, the distance of the section k72 is longer than the other sections k71 and k73 to k76, and the section velocity of the section k72, in which the time information is calculated together, is faster than the section velocities of the other sections k71 and k73 to k76. For example, the section velocities of the sections k71 and k73 to k76 are calculated as "low velocity" as 12 km/h, 23 km/h, 20 km/h, 21 km/h, and 20 km/h, respectively, whereas the section velocity of the section k72 is calculated as "normal" velocity as 40 km/h. When the section velocity of the section k72 deviates greatly from the section velocities of the previous and subsequent sections k71 and k73, the section velocity of the section k72 may be corrected by the average of the section velocities of the previous and subsequent sections k71 and k73. Thus, the calculation accuracy of the section velocity may be improved.

In the above example, a case is described in which the section velocity of a section including the position P73R that laterally deviates from the road link L7 is corrected. However, the embodiments are not limited thereto, and the link selection process does not necessarily need to use the section velocity obtained in a section including the position information and the time information of the position P73R (see FIG. 15), which laterally deviates from the road link, in the determination of whether the congestion level of a road link will be generated or not. That is, the section velocity does not necessarily need to be calculated from the position information and the time information of the position P73R (see FIG. 15) and the calculated section velocity does not necessarily need to be compared with the lowest velocity vmin.

In the third embodiment, a case is described in which the position information and the time information closest to the ending point LE of the road link L4 are determined by excluding the position information and the time information within a predetermined distance from the ending point LE of the road link L4. However, in addition to or instead of this, the position information and the time information closest to the starting point of a road link may be determined by excluding the position information and the time information within a predetermined distance from the starting point of the road link. Thus, the velocity based on the position information of a position such as a connection point of roads, which is likely to be influenced by a traffic signal and various restrictions, is excluded from the position information used for generation of the congestion level of a road link, and the accuracy of the generated congestion level is improved.

In the third embodiment, a case is described in which the position information and the time information closest to the ending point LE of the road link L4 are determined by excluding the position information and the time information within a predetermined distance from the ending point LE of the road link L4. However, the embodiments are not limited thereto, and when the position information and the time information closest to the ending point of a road link are determined, the position information and the time information closest to the ending point of the road link among pieces of position information and time information excluding a section continuous from the ending point of the road link while exhibiting a velocity outside a predetermined velocity range may be determined. For example, the velocity outside the predetermined velocity range may include a range less than or equal to the walking velocity of a pedestrian and a range exceeding the legal speed limit of a road. Thus, the congestion information of the road link can be generated by excluding information on a section in which an automobile decelerates due to waits for traffic signals. That is, the velocity based on the position information of a position such as a connection point of roads, which is likely to be influenced by a traffic signal and various restrictions is excluded from the position information used for generation of the congestion level of a road link, and the accuracy of the generated congestion level may be improved.

Similarly, when the position information and the time information closest to the starting point of a road link are determined, the position information and the time information closest to the starting point of the road link among pieces of position information and time information excluding a section continuous from the starting point of the road link while exhibiting a velocity outside a predetermined velocity range may be determined.

In each of the above illustrated embodiments, a case is described in which the velocity determination process determines whether the section velocities of all the sections in a road link are less than or equal to the lowest velocity vmin. However, the embodiments are not limited thereto, and in the velocity determination process, in addition to or instead of comparing with the lowest velocity, the highest velocity vmax may be determined, and when the section velocity exceeds the highest velocity vmax, the congestion information does not necessarily need to be generated for the road link. For example, a velocity range suitable for generation of the congestion information can be determined by the lowest velocity vmin and the highest velocity vmax. In this case, when the section velocity outside a predetermined velocity range of which the lower limit is the lowest velocity vmin and the upper limit is the highest velocity vmax is not used for generation of the congestion information, it is possible to easily and adequately exclude a link velocity of a moving object other than an automobile, which may not be suitable for generation of the congestion information from the link velocities obtained from the information from the mobile information device.

In each of the above illustrated embodiments, a case is described in which, when the section velocities of all the sections of a road link are lower than the lowest velocity vmin or exceed the highest velocity vmax, the information based on the mobile information device is not used for generation of the congestion information. However, the embodiments are not limited thereto, and when the section velocities of partial sections of a road link are lower than the lowest velocity vmin or exceed the highest velocity vmax, the information based on the mobile information device does not necessarily need to be used for generation of the congestion information. For example, it may be determined for each mobile information device whether the link velocity calculated for a road link will be used for generation of the congestion information based on a predetermined number or more of section velocities among the section velocities calculated for respective sections of the road link. Thus, it is possible to determine the information based on the mobile information device, which is not used for generation of the congestion information based on the percentage of a plurality of sections in which the section velocities are lower than the lowest velocity or exceed the highest velocity.

In each of the above illustrated embodiments, a case is described in which the section velocities of all the sections of a road link are lower than the lowest velocity vmin or exceed the highest velocity vmax. However, the embodiments are not limited thereto, and the lower limit velocity lower than the lowest velocity vmin or the upper limit velocity higher than the highest velocity may be set, and the link velocity including a section in which the velocity is less than or equal to the lower limit velocity or greater than or equal to the upper limit velocity does not necessarily need to be used for generation of the congestion information. Thus, it is possible to eliminate noise in generation of the congestion information, included in the information obtained from the mobile information device.

In each of the above illustrated embodiments, a case is described in which the congestion level is classified into three ranks. However, the embodiments are not limited thereto, and the congestion level may be classified into two ranks and may be classified into four or more ranks. Such classification can be changed by properly setting the threshold required for classification.

In each of the above illustrated embodiments, a case is described in which the mobile information device 21 is a smartphone or a feature phone. However, the embodiments are not limited thereto, and the mobile information device 21 may be a device that can be moved together with the moving object, such as a PC, a tablet, or a wearable device as long as the device can detect position information, map the position information on a road link, and transmit respective pieces of information.

Therefore, the present examples and embodiments are to be considered as illustrative and not restrictive and the invention is not to be limited to the details given herein.

The invention claimed is:

1. A congestion information generation device comprising:

a link velocity calculator configured to calculate a link velocity of a road link for one or more mobile information devices, wherein a plurality of pieces of position information and time information acquired from the one or more mobile information devices are mapped on the road link;

an information generator configured to generate congestion information of the road link based on the calculated link velocity of the road link; and a section velocity calculator configured to calculate a section velocity of a plurality of sections of the road link for each of the mobile information devices, wherein the information generator is configured to determine, for each of the mobile information devices, whether the link velocity calculated of the road link will be used for generation of the congestion information, wherein when all the section velocities are calculated in the road link, the information generator is configured to determine the road link as a subject of which the congestion information is to be generated, and when all of the section velocities are not calculated in the road link, the information generator is configured not to determine the road link as a subject of which the congestion information is to be generated, wherein the information generator is configured such that, when the road link determined as the subject of which the congestion information is to be generated is connected to a non-determined road link and is adjacent to a railroad track, the link velocity calculated for the determined road link is not used for generation of the congestion information, when "a road link correlated with position information" is present next to a "section in which position information is not correlated with a road link", the information generator is configured to determine whether the road link extends in parallel with the railroad track, when it is determined that the road link does not extend in parallel with the railroad track, and when a "road link correlated with position information" is present ahead even if two or more "sections in which position information is not correlated with a road link" are present, the information generator is configured to determine whether the road link extends in parallel with the railroad track.

2. The congestion information generation device according to claim 1, wherein the link velocity calculator is configured to calculate the link velocity of the road link from a position information and a time information closest to a starting point of the road link, and a position information and a time information of an ending point of the road link, and wherein the position information and the time information are from the plurality of pieces of position information and time information mapped on the road link.

3. The congestion information generation device according to claim 2, wherein the link velocity calculator is configured to perform at least one of:

exclusion of the position information and the time information within a predetermined distance from the starting point of the road link when determining the position information and the time information closest to the starting point of the road link; and exclusion of the position information and the time information within the predetermined distance from the ending point of the road link when determining the position information and the time information closest to the ending point of the road link.

4. The congestion information generation device according to claim 2, wherein the link velocity calculator is configured to perform at least one of:

exclusion of a section that is continuous from the starting point of the road link while exhibiting a velocity outside a predetermined velocity range when determining the position information and the time information closest to the starting point of the road link; and exclusion of a section that is continuous from the ending point of the road link while exhibiting a velocity outside the predetermined velocity range when determining the position information and the time information closest to the ending point.

5. The congestion information generation device according to claim 1, wherein the section velocity calculator is configured to calculate the section velocity based on the plurality of pieces of position information and time information mapped on the road link.

6. The congestion information generation device according to claim 1, wherein the information generator is configured to determine whether the link velocity will be used for generation of the congestion information based on at least a predetermined number of the section velocities.

7. The congestion information generation device according to claim 1, wherein the information generator is configured such that, when all the section velocities calculated in the road link are less than or equal to a predetermined value, the link velocity obtained from the mobile information device is not used for generation of the congestion information.

8. The congestion information generation device according to claim 1, wherein the information generator is configured to determine a plurality of the road links in a first sequence as subjects of which the congestion information is to be generated, a road route, which includes the plurality of road links, forms the road links in a second sequence, and the information generator is configured such that, when the first sequence is different from the second sequence, the link velocities calculated for the road link determined in the first sequence are not used for generation of the congestion information.

9. A congestion information generation method comprising:

calculating a link velocity of a road link for one or more mobile information devices, wherein a plurality of pieces of position information and time information acquired from the one or more mobile information devices are mapped on the road link;

generating congestion information of the road link based on the calculated link velocity of the road link;

calculating a section velocity of a plurality of sections of the road link for each of the mobile information devices;

determining, for each of the mobile information devices, whether the link velocity will be used for generation of the congestion information;

determining the road link as a subject of which the congestion information is to be generated when all the section velocities are calculated in the road link, and not determining the road link as a subject of which the congestion information is to be generated when all of the section velocities are not calculated in the road link, wherein when the road link determined as the subject of which the congestion information is to be generated is connected to a non-determined road link and is adjacent to a railroad track, the link velocity calculated for the determined road link is not used for generation of the congestion information, the congestion information generation method further comprising:

when "a road link correlated with position information" is present next to a "section in which position information is not correlated with a road link", determining whether the road link extends in parallel with the railroad track; and when it is determined that the road link does not extend in parallel with the railroad track, and when a "road link correlated with position information" is present ahead even if two or more "sections in which position information is not correlated with a road link" are present, determining whether the road link extends in parallel with the railroad track.

10. The congestion information generation method according to claim 9, further comprising calculating the link velocity of the road link from a position information and a time information closest to a starting point of the road link, and a position information and a time information of an ending point of the road link, wherein the position information and the time information are from the plurality of pieces of position information and time information mapped on the road link.

11. The congestion information generation method according to claim 10, wherein the method comprises at least one of:

exclusion of the position information and the time information within a predetermined distance from the starting point of the road link when determining the position information and the time information closest to the starting point of the road link; and exclusion of the position information and the time information within the predetermined distance from the ending point of the road link when determining the position information and the time information closest to the ending point of the road link.

12. The congestion information generation method according to claim 10, wherein the method comprises at least one of:

exclusion of a section that is continuous from the starting point of the road link while exhibiting a velocity outside a predetermined velocity range when determining the position information and the time information closest to the starting point of the road link; and exclusion of a section that is continuous from the ending point of the road link while exhibiting a velocity outside the predetermined velocity range when determining the position information and the time information closest to the ending point.

13. The congestion information generation method according to claim 9, further comprising calculating the section velocity based on the plurality of pieces of position information and time information mapped on the road link.

14. The congestion information generation method according to claim 9, further comprising determining whether the link velocity will be used for generation of the congestion information based on at least a predetermined number of the section velocities.

15. The congestion information generation method according to claim 9, wherein when all the section velocities calculated in a road link are less than or equal to a predetermined value, the link velocity obtained from the mobile information device is not used for generation of the congestion information.

16. The congestion information generation method according to claim 9, further comprising determining a plurality of the road links in a first sequence as subjects of which the congestion information is to be generated, and determining a road route, which includes the plurality of road links, as forming the road links in a second sequence, wherein when the first sequence is different from the second sequence, the link velocities calculated for the road link in the first sequence are not used for generation of the congestion information.

* * * * *